US008256217B2

(12) United States Patent
Inoue

(10) Patent No.: US 8,256,217 B2
(45) Date of Patent: Sep. 4, 2012

(54) SYSTEM AND METHOD FOR DETERMINING ACCELERATION OF AN INTERNAL COMBUSTION ENGINE

(75) Inventor: Masahiro Inoue, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 821 days.

(21) Appl. No.: 12/223,650

(22) PCT Filed: Mar. 28, 2007

(86) PCT No.: PCT/IB2007/000947

§ 371 (c)(1),
(2), (4) Date: Aug. 6, 2008

(87) PCT Pub. No.: WO2007/110774

PCT Pub. Date: Oct. 4, 2007

(65) Prior Publication Data

US 2009/0050119 A1 Feb. 26, 2009

(30) Foreign Application Priority Data

Mar. 28, 2006 (JP) ..... 2006-088411

(51) Int. Cl.

| | |
|---|---|
| ***F02B 33/44*** | (2006.01) |
| ***F02M 51/00*** | (2006.01) |
| ***F02G 3/00*** | (2006.01) |
| ***F01L 1/34*** | (2006.01) |
| ***F01N 5/04*** | (2006.01) |
| ***F01N 3/00*** | (2006.01) |

(52) U.S. Cl. ..... 60/605.1; 60/611; 60/615; 60/280; 60/285; 123/492; 123/90.15

(58) Field of Classification Search ..... 60/605, 60/605.1, 611, 615, 280, 285; 123/492, 90.15
See application file for complete search history.

(56) References Cited

U.S. PATENT DOCUMENTS 6,425,357 B2 * 7/2002 Shimizu et al. ..... 123/90.16

(Continued)

FOREIGN PATENT DOCUMENTS

CN 1505733 A 6/2004

(Continued)

OTHER PUBLICATIONS

Aug. 31, 2010 Office Action issued in Japanese Patent Application No. 2006-088411 (with translation).

(Continued)

*Primary Examiner* — Thomas Denion
*Assistant Examiner* — Michael Carton
(74) *Attorney, Agent, or Firm* — Oliff & Berridge, PLC

(57) ABSTRACT

An ECU for determining whether a request for acceleration is made to a supercharged internal combustion engine includes an acceleration request determining unit that determines whether a pressure difference between the upstream pressure and downstream pressure of a throttle valve disposed in an intake system is equal to or smaller than a predetermined value, and determines that a request for acceleration is made when the pressure difference is equal to or smaller than the predetermined value. The ECU also includes a variable valve actuating mechanism control unit that controls an InVVT and an ExVVT so that the intake charging efficiency and output torque of the engine become equal to the maximum intake charging efficiency and output torque at a certain downstream pressure when the acceleration request determining unit determines that a request for acceleration is made.

12 Claims, 7 Drawing Sheets

U.S. PATENT DOCUMENTS

| | | | | |
|---|---|---|---|---|
| 6,619,258 | B2 * | 9/2003 | McKay et al. | 123/350 |
| 2002/0017277 | A1 | 2/2002 | Kanno | |
| 2004/0149268 | A1 | 8/2004 | Hasegawa et al. | |
| 2006/0196182 | A1 * | 9/2006 | Kimoto et al. | 60/605.1 |
| 2006/0201152 | A1 * | 9/2006 | Irisawa | 60/605.1 |
| 2006/0243231 | A1 * | 11/2006 | Hasegawa et al. | 123/90.15 |
| 2007/0012296 | A1 * | 1/2007 | Kakinuma et al. | 123/492 |

FOREIGN PATENT DOCUMENTS

| | | | |
|---|---|---|---|
| EP | 1 437 498 | A1 | 7/2004 |
| EP | 1 447 550 | A1 | 8/2004 |
| JP | A 59-176433 | | 10/1984 |
| JP | A-61-207857 | | 9/1986 |
| JP | A 1-106934 | | 4/1989 |
| JP | A-5-321804 | | 12/1993 |
| JP | A-8-165947 | | 6/1996 |
| JP | A 11-257109 | | 9/1999 |
| JP | A 2001-355466 | | 12/2001 |
| JP | A-2003-3871 | | 1/2003 |
| JP | A-2003-211997 | | 7/2003 |
| JP | A 2004-183512 | | 7/2004 |
| JP | A 2004-245104 | | 9/2004 |
| JP | A-2004-316531 | | 11/2004 |
| JP | A-2005-069045 | | 3/2005 |
| JP | A-2006-017053 | | 1/2006 |
| JP | A-2006-70791 | | 3/2006 |

OTHER PUBLICATIONS

Office Action issued in Chinese Application No. 200780011674.X dated Jun. 5, 2012 (with translation).

* cited by examiner

SYSTEM AND METHOD FOR DETERMINING ACCELERATION OF AN INTERNAL COMBUSTION ENGINE

BACKGROUND OF THE INVENTION

1. Field of the Invention

The invention relates to acceleration request determining system, acceleration request determining method, and control system and control method of an internal combustion engine. In particular, the invention relates to acceleration request determining system and method and control system and method of an internal combustion engine, which improve the output performance of the engine and the fuel economy when appropriate, while assuring sufficient levels of the output performance and the fuel economy at the same time.

2. Description of the Related Art

As a control technology for an internal combustion engine, it is known to determine whether a request for acceleration is made in order to, for example, improve the output performance of the engine. For example, the presence of a request for acceleration is determined based on, for example, the opening of a throttle valve that is controlled in accordance with the amount of depression of the accelerator pedal, as described in the Japanese patent application publication No. JP-A-2004-245104 as one embodiment of the invention. Also, in an internal combustion engine having a turbocharger and a variable valve actuating mechanism, it is known to extend a valve overlap, namely, a period in which intake valves and exhaust valves are both open. For example, the Japanese patent application publication No. JP-A-2004-245104 describes a turbo charged engine in which the valve overlap of the intake and exhaust valves is extended when a request for acceleration is made. Also, the Japanese patent application publication No. JP-A-H11-257109 describes an air-fuel ratio control system of an internal combustion engine, which extends the valve overlap when the engine operates at a rich air-fuel ratio, such as when the engine operates at a high load. In the turbo charged engine of the Japanese patent application publication No. JP-A-2004-245104, the valve overlap is extended so as to bring about secondary combustion of unburned HC, thereby to reduce a turbo lag of the turbocharger. The air-fuel ratio control system of the Japanese patent application publication No. JP-A-H11-257109 extends the valve overlap so as to make the exhaust air-fuel ratio equal to the stoichiometric ratio or lean, thereby to maintain the converting or purifying capability of a catalyst at a sufficiently high level and thus prevent an increase of unburned HC in the exhaust gas.

In the meantime, the pressure measured at the upstream side of the throttle valve (which will be simply referred to as "upstream pressure") changes with changes in the environment and also changes with time. More specifically, in the case where the vehicle is at a high altitude, for example, the atmospheric pressure is low; therefore, the intake air density is reduced, and the upstream pressure is also reduced. In a vehicle equipped with a turbo charged engine, for example, if the cooling efficiency of an intercooler is reduced, the intake air density decreases as the ability to cool the intake air deteriorates, and a pressure loss of intake air in the intercooler increases as the intake temperature increases. As a result, the upstream pressure of the throttle valve located downstream of the intercooler is also reduced.

FIG. 7A and FIG. 7B schematically illustrate problems encountered in an internal combustion engine in the case where the presence of a request for acceleration is determined based on the accelerator pedal position or the opening of the throttle valve. More specifically, FIG. 7A shows the relationships between the opening of the throttle valve and the intake air amount (or flow rate of intake air), with respect to the case where the vehicle is in normal conditions and the case where the vehicle is, for example, at a high altitude. FIG. 7B shows the relationships between the opening of the throttle valve and the pressure measured at the downstream side of the throttle valve (which will be simply called "downstream pressure"), with respect to the case where the vehicle is in normal conditions and the case where the vehicle is, for example, at a high altitude. In FIG. 7A and FIG. 7B, the vehicle is said to be, for example, at a high altitude when it is subjected to any environmental changes or chronological changes resulting in a reduction of the upstream pressure of the throttle valve, and the vehicle is said to be in normal conditions when subjected to none of such changes. In FIG. 7A and FIG. 7B, the horizontal axis that indicates the opening of the throttle valve has the same scale.

As shown in FIG. 7A, when the vehicle is, for example, at a high altitude, the intake air amount is reduced as compared with the normal case (i.e., the case where the vehicle is in normal conditions) with respect to the same opening of the throttle valve. In this case, it is necessary in the case where the vehicle is, for example, at a high altitude to increase the opening of the throttle valve so as to provide the same amount of engine output or power as that provided in the normal case. Since the fuel injection control is generally performed based on the throttle opening and the engine speed, the air fuel ratio goes out of an appropriate range at this stage. This condition may also be recognized in FIG. 7B, in which the downstream pressure gradually increases in both of the cases as the opening of the throttle valve increases, whereas the upstream pressure is lower in the case of a high altitude than that in the normal case. Thus, in the normal case, the upstream pressure and the downstream pressure become substantially equal to each other when the throttle valve is opened by a sufficiently large degree. In the case where the vehicle is, for example, at a high altitude, on the other hand, the upstream pressure and the downstream pressure become substantially equal to each other at an earlier point in time, namely, before the throttle valve is sufficiently largely opened. In the following description, the condition in which the upstream pressure and the downstream pressure become substantially equal to each other will be simply called WOT (Wide Open Throttle) point. It will be understood from the above description that the WOT point changes if the upstream pressure of the throttle valve changes. Once the throttle opening reaches the WOT point, it cannot be expected to increase the intake air amount by opening the throttle valve by a larger degree than that of the WOT point, and it is thus necessary to improve the intake charging efficiency by use of, for example, a turbocharger, so as to further improve the output performance of the engine.

Suppose that the presence of a request for acceleration is determined when the opening of the throttle valve that is controlled in accordance with the amount of depression of the accelerator pedal reaches opening X2 as indicated in FIG. 7B. In this case, where the vehicle is, for example, at a high altitude, it is not determined that a request for acceleration is made until the accelerator pedal is depressed to such an extent that the throttle opening becomes equal to or larger than the opening X2. Namely, since it cannot be expected to increase the intake air amount by opening the throttle valve by a degree equal to or larger than that of the WOT point, the engine is insensitive to changes in the throttle opening (or the amount of depression of the accelerator pedal) in a region from the throttle opening of the WOT point to the opening X2 in the case where the vehicle is, for example, at a high altitude.

Consequently, the output performance of the engine is improved when appropriate so as to match the intention of the driver who depresses the accelerator pedal in an attempt to increase the output or power of the engine, resulting in deterioration of the driveability. Suppose that the presence of a request for determination is determined when the opening of the throttle valve that is controlled in accordance with the amount of depression of the accelerator pedal reaches opening X1 as indicated in FIG. 7B. In this case, when the accelerator pedal is depressed in the normal case, it is determined that a request for acceleration is made at a point in time earlier than the time when the throttle opening reaches the WOT point for the normal case, and, therefore, a process for improving the output performance is performed based on the request for acceleration even if the engine is still capable of generating power by itself. In this case, the output performance is improved while sacrificing the fuel economy (i.e., with a result of reduction of the fuel economy), and the balance between the fuel economy and the output performance may deteriorate. Thus, the method of the related art in which the presence of a request for acceleration is determined based on the throttle opening or accelerator pedal position cannot satisfactorily deal with the situation where the WOT point changes with environmental changes and/or chronological changes. Thus, the method of the related art is not able to favorably improve the output performance and fuel economy of the engine based on a request for acceleration, while assuring sufficient levels of the output performance and fuel economy at the same time.

SUMMARY OF THE INVENTION

The invention provides an acceleration request determining system and a control system of an internal combustion engine, which improve the output performance of the engine and the fuel economy when appropriate, while assuring sufficient levels of the output performance and the fuel economy at the same time.

A first aspect of the invention relates to an acceleration request determining system for determining whether a request for acceleration is made to an internal combustion engine. The acceleration request determining system is characterized by including acceleration request determining means for determining whether a request for acceleration is made, based on an upstream pressure and a downstream pressure of a throttle valve disposed in an intake system of the internal combustion engine. The acceleration request determining system is characterized in that the upstream pressure and downstream pressure of the throttle valve, which determine the WOT point, are used as criteria of judgment on the presence of a request for acceleration, so that the presence of a request for acceleration can be determined on the basis of the WOT point. The acceleration request determining system is able to determine whether, a request for acceleration is made on the basis of the WOT point, even if the WOT point changes with environmental changes or chronological changes. By controlling suitable objects to be controlled, based on the request for acceleration determined by the acceleration request determining system, it is possible to improve the output performance of the engine and the fuel economy when appropriate, while assuring sufficient levels of the output performance and the fuel economy at the same time. While it is preferable that the pressures used as criteria of judgment be directly detected based on output signals of pressure sensors or the like, the pressures are not limited to those derived from direct measurements, but may be estimated through, for example, computing. Namely, the pressures as criteria of judgment mean those indicative of the upstream pressure and the downstream pressure. While it is most preferable to use a request for acceleration determined by the acceleration request determining system for controlling objects, to be controlled which are capable of favorably improving the output performance of the engine, the invention is not limited to this application, but the request for acceleration may be used for controlling suitable objects to be controlled for various purposes, so as to solve various problems arising from accelerated conditions of the vehicle.

The acceleration request determining system as described above may further include pressure difference detecting means for detecting a pressure difference between the upstream pressure and downstream pressure of the throttle valve, and the acceleration request determining means may determine whether the pressure difference detected by the pressure difference detecting means is equal to or smaller than a predetermined value, and determine that a request for acceleration is made when the pressure difference is equal to or smaller than the predetermined value. For example, the presence or absence of a request for acceleration may be determined on the basis of the WOT point. In the above form of the invention, one condition under which the acceleration request determining means determines that a request for acceleration is made is indicated by way of example, though the presence of a request for acceleration may be finally determined based on this condition and other conditions. Accordingly, if there are no other particular conditions to be considered, or all of the other conditions are satisfied, the acceleration request determining means determines that a request for acceleration is made when it determines that the pressure difference is equal to or smaller than the predetermined value. In another form of the invention, the acceleration request determining means may determine the presence of a request for acceleration based on, for example, the pressure ratio of the upstream pressure to the downstream pressure.

A second aspect of the invention relates to a control system of an internal combustion engine. The control system of the engine including the acceleration request determining system as described above, a supercharger that boosts a pressure of intake air supplied to the engine, a variable valve actuating mechanism that changes valve characteristics of at least one of an intake valve and an exhaust valve of the engine, variable valve actuating mechanism control means for controlling the variable valve actuating mechanism so as to change the valve characteristics of at least one of the intake valve and the exhaust valve when the acceleration request determining means determines that a request for acceleration is made. The variable valve actuating mechanism combined with, for example, a supercharged engine is a preferable one of the objects to be controlled using the request for acceleration determined by the acceleration request determining system of the first aspect of the invention, since the control of the variable valve actuating mechanism is expected to provide a greater effect, particularly by solving the above-described problem due to changes in the performance of the intercooler.

The above-mentioned valve characteristics are to be interpreted to include the valve lift as well as the valve timing. As a manner of changing the valve characteristics, it is preferable to change the valve characteristics in view of the supercharging (e.g., turbo charging) effect of the supercharger so as to provide the maximum intake charging efficiency and maximum output torque after changing thereof. In one example of the manner of changing the valve characteristics, in particular, the valve timing, the variable valve actuating mechanism control means preferably controls the variable valve actuating mechanism so as to advance the valve timing of the intake valve so that the amount of intake air charged in the cylinder is increased at an equal downstream pressure. To provide a more favorable manner of changing the valve characteristics, the control system preferably stores map data of the optimum valve characteristics which are defined by the engine speed and the downstream pressure that reflects the supercharging effect and an influence of a pumping loss, as the valve characteristics that provide the maximum intake charging efficiency and maximum output torque.

The variable valve actuating mechanism control means may control the variable valve actuating mechanism so as to retard the valve timing of the exhaust valve. Furthermore, the variable valve actuating mechanism control means may control the variable valve actuating mechanism so as to advance the valve timing of the intake valve and retard the valve timing of the exhaust valve. Thus, the valve overlap is extended when not only the valve timing of the intake valve is advanced but also the valve timing of the exhaust valve is retarded. If the valve overlap is extended during a transient supercharging (e.g., turbo-charging) period, the amount of intake air that flows through the cylinder is effectively increased so that the amount of gas remaining in the cylinder can be reduced, whereby the possibility of occurrence of knocking can be favorably reduced. The supercharged internal combustion engine is not limitedly supercharged by a turbocharger, but may be supercharged by a suitable supercharger, such as a mechanical supercharger. In the case where the supercharged engine is supercharged by a turbocharger, in particular, the turbo-charging effect is enhanced by an increase of the exhaust energy resulting from the changing of the valve characteristics by the variable valve actuating mechanism as described above and changing of the ignition timing as described later. Thus, the increased exhaust energy and the turbo-charging effect provide synergistic effects, such as an increase in the amount of intake air charged in the cylinder and an increase in the amount of intake air that flows through the cylinder.

The control system of the internal combustion engine may further include supercharger control means for controlling the supercharger when the acceleration request determining means determines that a request for acceleration is made. The control system of the engine makes it possible to reduce a turbo lag by suitably controlling the supercharger, thereby to more favorably improve the output performance of the engine.

The control system of the internal combustion engine may further include ignition timing control means for controlling ignition timing of the engine, and the ignition timing control means may advance the ignition timing of the engine when the acceleration request determining means determines that a request for acceleration is made. The control system of the engine makes it possible to more favorably improve the output performance, by advancing the ignition timing by a degree corresponding to a reduction of the possibility of knocking. Not only in the case where the presence of a request for acceleration is determined, but also in the case where the amount of intake air that flows through the cylinder is increased due to changing of the valve characteristics, the ignition timing control means of the invention may advance the ignition timing so as to improve the output performance of the engine. In particular, it is desirable to increase the amount of intake air that flows through the cylinder during a transient turbo-charging period, in order to improve the output performance.

The control system of the internal combustion engine may further include air fuel ratio determining means for determining whether the air fuel ratio of exhaust gas downstream of a catalyst disposed in an exhaust system of the engine is lean, and the variable valve actuating mechanism control means may control the variable valve actuating mechanism so as to stop changing the valve characteristics when the air fuel ratio determining means determines that the air fuel ratio is lean. If the amount of intake air that flows through the cylinder continues to be increased even after the air fuel ratio becomes lean, the catalyst adsorbs an increased amount of oxygen, and the purifying or converting capability of the catalyst may deteriorate. With the control system of the engine as described above, the amount of intake air that flows through the cylinder stops being increased, and, therefore, otherwise possible deterioration of the purifying capability of the catalyst can be suppressed or prevented. Not only in the case where the presence of a request for acceleration is determined, but also in the case where the amount of intake air that flows through the cylinder is increased due to changing of the valve characteristics, it is possible to suppress deterioration of the purifying capability of the catalyst by stopping changing the valve characteristics in the same manner as in the above-described control system of the engine.

The control system of the internal combustion engine may further include air fuel ratio determining means for determining whether an air fuel ratio of exhaust gas downstream of a catalyst disposed in an exhaust system of the engine is lean. When the air fuel ratio determining means determines that the air fuel ratio is lean, and the valve characteristics of the intake valve and the exhaust valve are changed, the variable valve actuating mechanism control means may control the variable valve actuating mechanism so as to return the valve characteristics of the exhaust valve to those before changing, in advance of the valve characteristics of the intake valve. After the air fuel ratio becomes lean, it is desirable to return the valve characteristics to those before changing, as in the control system of the engine as described above. If the valve characteristics of the intake valve are returned even in the presence of a request for acceleration, the intake air amount may be significantly reduced, and the driveability may be affected. In the control system of the engine as described above, the valve characteristics of the exhaust valve are returned to those before changing, prior to returning of the valve characteristics of the intake valve, so that deterioration of the purifying capability of the catalyst can be favorably suppressed. Not only in the case where the presence of a request for acceleration is determined, but also in the case where the amount of intake air that flows through the cylinder is increased due to changing of the valve characteristics, it is possible to suppress deterioration of the purifying capability of the catalyst by returning the valve characteristics in the same manner as in the control system of the engine as described above.

In the control system of the internal combustion engine as described above, when the acceleration request determining means determines that no request for acceleration is made, and the valve characteristics of the intake valve and the exhaust valve are changed, the variable valve actuating mechanism control means may control the variable valve actuating mechanism so as to return the valve characteristics of the intake valve to those before changing, in advance of the valve characteristics of the exhaust valve. When no request for acceleration is made, it is desirable to return the valve characteristics to those before changing as in the control system of the engine as described above. By returning the valve characteristics of the intake valve to those before changing prior to returning of the valve characteristics of the exhaust valve, it is possible to reduce a pumping loss, or the like, at an early stage to favorably improve the fuel economy, and also reduce the rate of change of the output performance. It is to be noted that the acceleration request determining means determines that no request for acceleration is made when the intake air amount reaches a target value after the presence of a request for acceleration is determined. Not only in the case where the presence of a request for acceleration is determined, but also in the case where the valve characteristics of the intake valve and exhaust valve are changed and the valve characteristics of the intake valve are changed so as to increase the amount of intake air charged, it is possible to favorably improve the fuel economy by returning the valve characteristics to those before changing, as is the case with the variable valve actuating mechanism control means of the control system of the engine as described above.

A third aspect of the invention relates to an acceleration request determining method for determining whether a request for acceleration is made to an internal combustion engine. The acceleration request determining method is characterized by including the steps of: determining whether a request for acceleration is made, based on an upstream pressure at the upstream side of a throttle valve disposed in an intake system of the internal combustion engine and a downstream pressure at the downstream side of the throttle valve.

A fourth aspect of the invention relates to a method of controlling an internal combustion engine including a supercharger that boosts a pressure of intake air supplied to the internal combustion engine, and a variable valve actuating mechanism that changes valve characteristics of at least one of an intake valve and an exhaust valve of the engine. The control method of the engine is characterized by including the steps of: determining whether a request for acceleration is made, based on an upstream pressure of a throttle valve disposed in an intake system of the engine and a downstream pressure of the throttle valve, and controlling the variable valve actuating mechanism so as to change the valve characteristics of at least one of the intake valve and the exhaust valve when it is determined that a request for acceleration is made.

According to the first through fourth aspects of the invention, an acceleration request determining system, an acceleration request determining method, a control system of an internal combustion engine, and a method of controlling an internal combustion engine are provided which are able to improve the output performance of the engine and the fuel economy when appropriate, while assuring sufficient levels of the output performance and the fuel economy at the same time.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF THE PREFERRED EMBODIMENTS

One embodiment of the invention will be described in detail with reference to the drawings.

Figure 1:
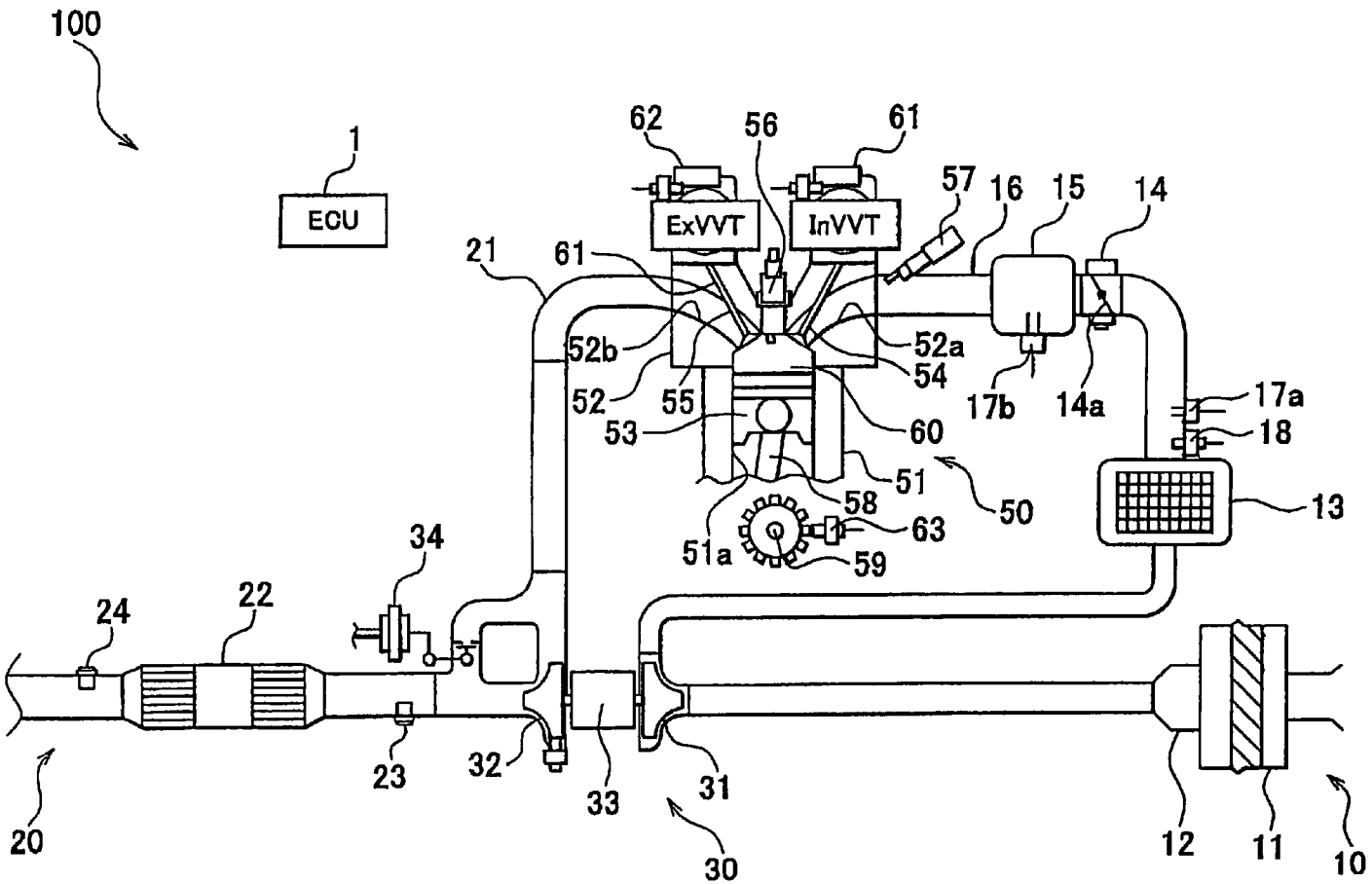
FIG. 1 is a view schematically showing a turbo charged internal combustion engine system having an ECU according to one embodiment of the invention.

FIG. 1 schematically illustrates a turbo-charged internal combustion engine system 100 having an ECU (Electronic Control Unit) 1 according to the embodiment of the invention. The turbo-charged engine system 100 includes the ECU 1, an intake system 10, an exhaust system 20, a turbocharger 30 as one type of superchargers, an internal combustion engine 50 and various sensors. The intake system 10 includes an air cleaner 11, an air flow meter 12, an intercooler 13, an electrically operated throttle device 14, a surge tank 15, an intake manifold 16, intake ports (only one of which is shown in FIG. 1 and the other intake ports are not shown), including an intake port 52*a*, which communicate with respective cylinders (only one of which is shown in FIG. 1, and the other cylinders are not shown), including a cylinder 51*a*, of the engine 50, and intake pipes provided as needed between these constituent components. The air cleaner 11 serves to filter intake air supplied to the engine 50, and communicates with the atmosphere via an air duct. The air flow meter 12 serves to measure the intake air amount, i.e., the flow rate of intake air, and generates a signal indicative of the intake air amount. The intercooler 13 serves to cool the intake air that has been compressed by the turbocharger 30. The electrically operated throttle device 14 serves to adjust the entire amount of intake air supplied to the engine 50 under control of the ECU 1, and includes a throttle valve 14*a*, an electric motor for driving the throttle valve 14*a*, a throttle angle sensor, and so forth. The surge tank 15 serves to temporarily store the intake air, and the intake manifold 16 serves to distribute the intake air from the surge tank 15 to the respective cylinders of the engine 50. The intake system 10 is also provided with a pressure sensor 17*a* for detecting the upstream pressure P1 of the electrically operated throttle device 14, more specifically, the throttle valve 14*a*, a pressure sensor 17*b* for detecting the downstream pressure P2 of the throttle valve 14*a*, and a temperature sensor 18 for detecting the temperature of the intake air that has passed the intercooler 13.

The exhaust system 20 includes exhaust ports (only one of which is shown in FIG. 1 and the other exhaust ports are not shown), including an exhaust port 52*b*, which communicates with the respective cylinders of the engine 50, an exhaust manifold 21, a three-way catalyst 22, a muffler (not shown), and exhaust pipes provided as needed between these constituent components. The exhaust manifold 21 is arranged to join exhaust passages corresponding to the respective cylinders into a single exhaust passage at the downstream side thereof, so as to merge exhaust streams from the respective cylinders into a single exhaust stream. The three-way catalyst 22 oxidizes hydrocarbon HC and carbon monoxide CO and reduces nitrogen oxides NOx so as to clean the exhaust gas. The exhaust system 20 further includes an A/F sensor 23 located upstream of the three-way catalyst 22, and an oxygen sensor 24 located downstream of the three-way catalyst 22. The A/F sensor 23 serves to detect the air fuel ratio of the exhaust gas upstream of the three-way catalyst 22, based on the oxygen concentration of the exhaust gas measured at the upstream side of the three-way catalyst 22. The oxygen sensor 24 serves to determine whether the air fuel ratio of the exhaust gas downstream of the three-way catalyst 22 is richer or leaner than the stoichiometric ratio, based on the oxygen concentration of the exhaust gas measured at the downstream side of the three-way catalyst 22.

The turbocharger 30 includes a compressor rotor 31, a turbine rotor 32, an assist motor 33, and a wastegate valve 34. The turbocharger 30 is positioned such that a compressor unit that contains the compressor rotor 31 is disposed in the intake system 10, and a turbine unit that contains the turbine rotor 32 is disposed in the exhaust system 20. The compressor rotor 31 and the turbine rotor 32 are connected to each other with a rotary shaft (not shown). When the turbine rotor 32 is driven by the exhaust gas, the compressor rotor 31 is driven via the rotary shaft so as to compress the intake air. The assist motor 33 has a rotor (not shown) mounted on the rotary shaft, and a stator (not shown). When a coil of the stator is energized under control of the ECU 1, the rotary shaft rotates so as to assist in driving of the compressor rotor 31. The wastegate valve 34 serves to control (i.e., reduce) the boost pressure to be equal to or lower than a predetermined level. When the wastegate valve 34 is opened, the exhaust gas passes through the wastegate valve 34 while bypassing the turbine rotor 32.

The internal combustion engine 50 includes a cylinder block 51, a cylinder head 52, pistons 53, intake valves 54, exhaust valves 55, ignition plugs 56, fuel injectors 57, connecting rods 58, a crankshaft 59, an intake-side VVT (Variable Valve Timing) mechanism 61, and an exhaust-side VVT mechanism 62. The engine 50 of this embodiment is an in-line four-cylinder turbo-charged gasoline engine. It is, however, to be understood that the invention is not limitedly applied to this type of engine, but may be applied to other suitable types of engines. For example, the engine 50 may have other suitable arrangements and number of cylinders, and may be a so-called direct-injection gasoline engine, a lean-burn engine, or any other type of engine. While FIG. 1 shows a principal part of the engine 50 associated with the cylinder 51*a* as a typical cylinder, the other cylinders are constructed similarly to the cylinder 51*a*.

Referring to FIG. 1, the cylinder 51*a* having a generally cylindrical shape is formed in the cylinder block 51. A piston 53 is received in the cylinder 51*a*. The cylinder head 52 is fixed to the upper surface of the cylinder block 51. A combustion chamber 60 is formed as a space defined by the cylinder block 51, cylinder head 52 and the piston 53. The cylinder head 52 is formed with an intake port 52*a* through which the intake air is drawn into the combustion chamber 60, and an exhaust port 52*b* through which combustion gas is discharged from the combustion chamber 60, and intake valve 54 and exhaust valve 55 are provided for opening and closing channels of the intake and exhaust ports 52*a* and 52*b*, respectively. An ignition plug 56 is mounted in the cylinder head 52 such that its electrode protrudes into an upper, middle portion of the combustion chamber 60. A fuel injector 57 is mounted in the intake manifold 16 such that its injection hole protrudes into the intake passage. The piston 53 is connected to the crankshaft 59 via a connecting rod 58, and the reciprocating motion of the piston 53 is converted into rotary motion of the crankshaft 59. The engine 50 is also provided with a crank angle sensor 63 that generates output pulses proportional to the engine speed Ne, and a water temperature sensor (not shown) for detecting the water temperature.

The intake-side VVT mechanism (hereinafter simply referred to as InVVT) 61 serves to change the valve timing of the intake valve 54, and has an intake-side camshaft and a hydraulic system, which are not illustrated. In the InVVT 61, the hydraulic system changes the phase of the intake-side camshaft relative to the phase of the crankshaft 59 under control of the ECU 1, so as to change the valve timing of the intake valve 54. The hydraulic system employs a mechanism that can continuously change the phase of the intake-side camshaft. The exhaust-side VVT mechanism (hereinafter simply referred to as ExVVT) 62 serves to change the valve timing of the exhaust valve 55, and has an exhaust-side camshaft and a hydraulic system, which are not illustrated. Like the InVVT 61, the ExVVT 62 is able to continuously change the valve timing of the exhaust valve 55 under control of the ECU 1. The InVVT 61 and ExVVT 62 may be replaced with other suitable mechanisms, such as those capable of changing the valve lift as well as the valve timing. In this embodiment, the InVVT 61 and ExVVT 62 provide a variable valve actuating mechanism.

The ECU 1 consists principally of CPU (Central Processing Unit), ROM (Read Only Memory), RAM (Random Access Memory), and input and output circuits, all of which are not illustrated in FIG. 1. The ECU 1 is configured to mainly control the engine 50. More specifically, the ECU 1 of this embodiment controls the electrically operated throttle device 14, fuel injector 56, ignition plug 57, turbocharger 30, InVVT 61 and ExVVT 62, and other components. The ROM stores programs in which various processes to be performed by the CPU for mainly controlling the engine 50 are described. In this embodiment, the ROM stores, for example, an acceleration request determination program for determining the presence of a request for acceleration, a pressure difference detection program for detecting a pressure difference (P1−P2) between the upstream pressure P1 and the downstream pressure P2, a turbocharger control program for driving the assist motor 33 of the turbocharger 30, a program for controlling the InVVT 61 and ExVVT 62 so as to change valve timing, an ignition timing control program for controlling ignition timing, and an air-fuel ratio determination program for making a judgment on the air fuel ratio based on the output signal of the oxygen sensor 24. These programs may be combined with other programs to provide a set of programs for controlling the engine 50, for example.

Various sensors, including the air flow meter 12, pressure sensors 17*a* and 17*b*, temperature sensor 18, A/F sensor 23, oxygen sensor 24, and the crank angle sensor 63, are connected to the ECU 1. To the ECU 1 are also connected various objects to be controlled, including the electrically operated throttle device 14, turbocharger 30, ignition plugs 56, fuel injectors 57, and the InVVT 61 and ExVVT 62, via drive circuits (not shown). In FIG. 1, connections between the ECU 1 and these components are not illustrated. In this embodiment, the CPU, ROM and RAM (hereinafter referred to as "CPU etc.") and the acceleration request determination program provide the acceleration request determining means, the CPU etc. and the pressure difference detection program provide the pressure difference detecting means, the CPU etc. and the program for controlling the turbocharger 30 provide the turbocharger control means, the CPU etc. and the program for controlling the InVVT 61 and Ex VVT 62 provide the variable valve actuating mechanism control means, the CPU etc. and the ignition timing control program provide the ignition timing control means, and the CPU etc. and the air-fuel ratio determination program provide the air-fuel ratio determining means. In this embodiment, the ECU 1 provides both the acceleration request determining system and the control system of the internal combustion engine.

Next, a control routine executed by the ECU 1 configured as described above for improving the output performance of the engine 50 according to a request for acceleration based on a pressure difference will be described in detail with reference to the flowchart shown in FIG. 2. The CPU repeatedly executes the control routine illustrated in the flowchart at extremely short time intervals, based on the above-described various programs stored in the ROM, so that the ECU 1 controls various objects to be controlled, based on the results of various determinations or judgments. Initially, the CPU performs a process for determining whether a request for acceleration is made (step 11). More specifically, in order to determine whether a request for acceleration is made, the CPU detects a pressure difference between the upstream pressure P1 and the downstream pressure P2, based on the output signals of the pressure sensors 17*a*, 17*b*, and determines whether the pressure difference is equal to or smaller than a predetermined value. If the pressure difference is equal to or smaller than the predetermined value, the CPU determines that a request for acceleration is made. In this step, the CPU determines whether the intake air amount reaches a predetermined target value in the next and subsequent cycles of the routine. If the intake air amount reaches the target value, the CPU determines that no request for acceleration is made even if the pressure difference is equal to or smaller than the predetermined value. The target value of the intake air amount is set as a value that indicates that the operation of the turbocharger 30 reaches a steady state. Namely, the operation of the turbocharger 30 is in a transient state until the intake air amount becomes equal to the target value.

Figure 2:
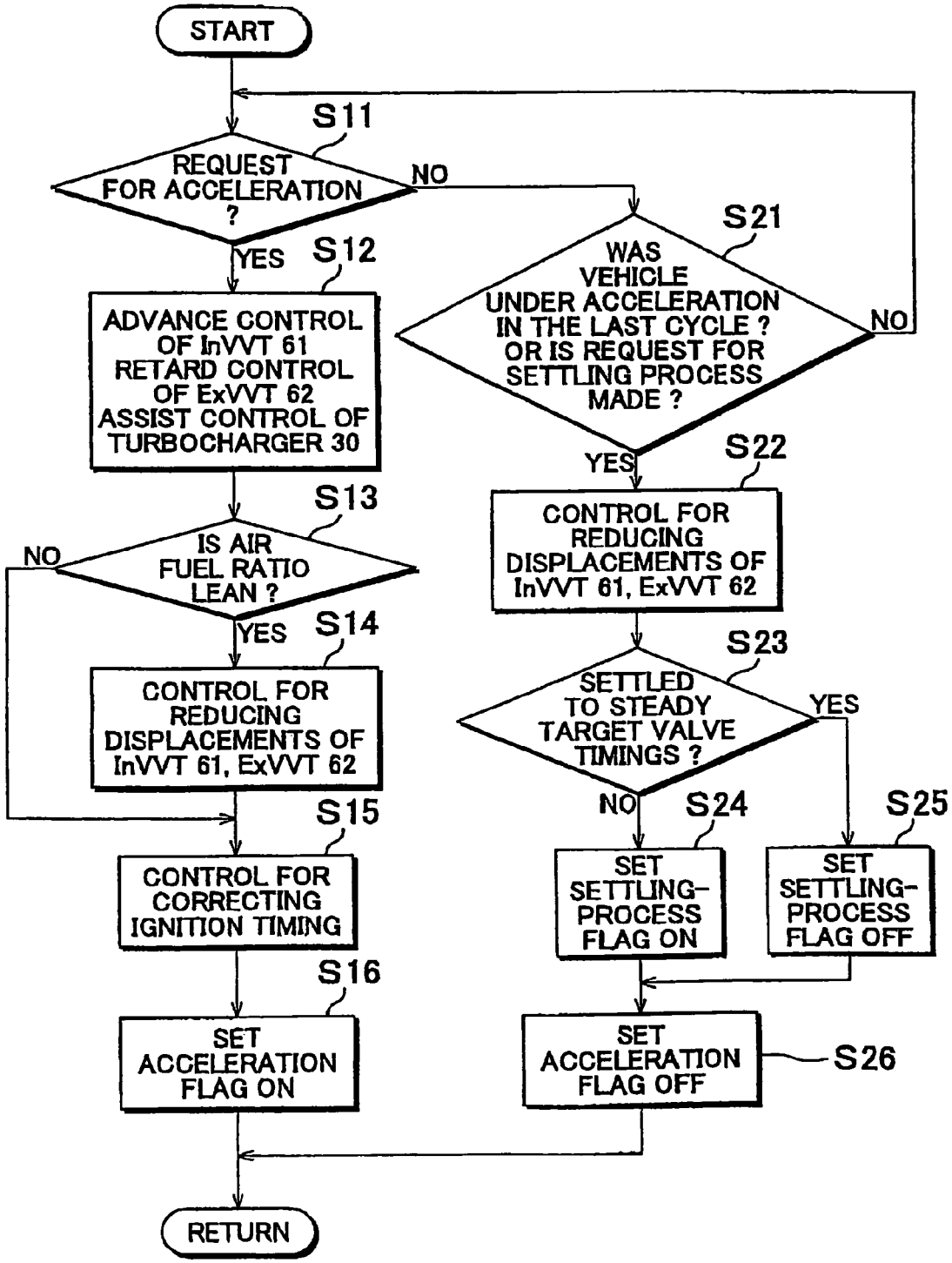
FIG. 2 is a flowchart illustrating a control routine executed by the ECU according to the embodiment of the invention.

The flowchart of FIG. 2 illustrates control flow that proceeds from a transient turbo-charging period (during which the operation of the turbocharger 30 is in a transient state) to a steady turbo-charging period (during which the operation of the turbocharger 30 is in a steady state). When the turbocharger 30 reaches a steady operating state (for example, when the pressure difference is substantially equal to zero ($P1-P2\approx 0$), and the upstream pressure P1 becomes equal to or higher than a predetermined value), the CPU determines the presence of a request for acceleration, based on the opening of the throttle valve that is controlled in accordance with the amount of depression of the accelerator pedal, and executes a process for performing certain control (for example, control similar to those of the related art). In step 11 of the flowchart of FIG. 2, the CPU may perform a process for detecting, for example, a pressure ratio (P1/P2), i.e., a ratio of the upstream pressure to the downstream pressure, in place of the pressure difference. In this case, the ROM may store a program for detecting the pressure ratio, instead of the pressure difference detection program, and the CPU may determine in step 11 whether the pressure ratio is equal to or smaller than a predetermined value. In this case, if it is determined that the pressure ratio is equal to or smaller than the predetermined value, it is determined that a request for acceleration is made.

Figure 3:
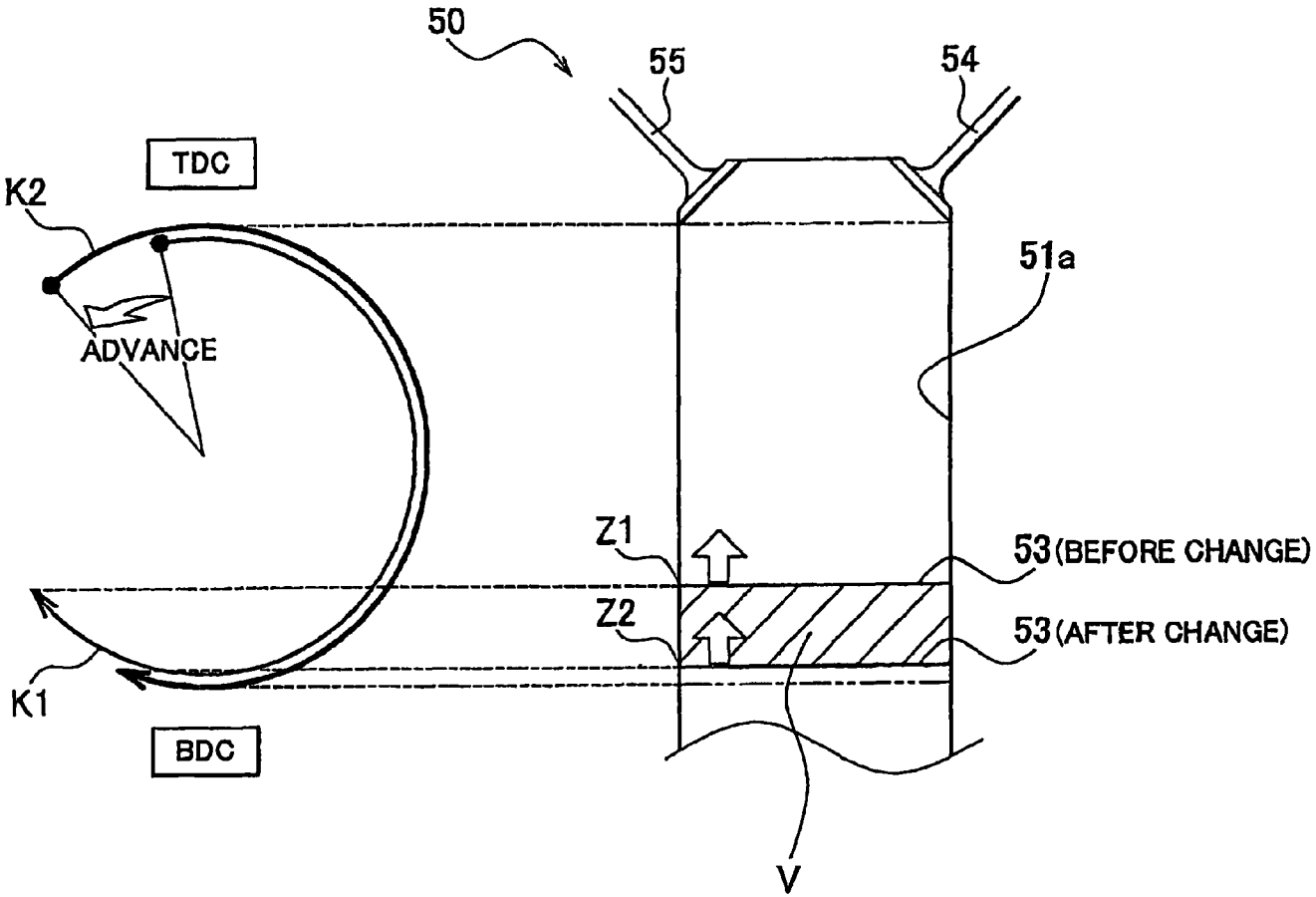
FIG. 3 is a view useful for explaining changing of the valve timing of an intake valve.

If it is determined in step 11 that a request for acceleration is made, the CPU performs a process for controlling the InVVT 61, more specifically, the hydraulic system mounted on the intake-side camshaft, so as to advance the valve timing of the intake valve 54. FIG. 3 schematically illustrates how the valve timing of the intake valve 54 is changed in step 12. More specifically, FIG. 3 includes a diagram of the valve timing and a view of a principal part of the engine 50 associated with the valve timing diagram, for illustrating conditions before and after changing of the valve timing of the intake valve 54. Before changing of the valve timing, the intake valve 54 is open for a period indicated by K1 in FIG. 3, and the top face of the piston 53 is located at Z1 when the intake valve 54 is closed. After changing of the valve timing, on the other hand, the intake valve 54 is open for a period indicated by K2 in FIG. 3, and the top face of the piston 53 is located at Z2 when the intake valve 54 is closed. If the valve timing of the intake valve 54 is advanced in this manner, the volume in the cylinder can be increased by an amount denoted by V in FIG. 3 when the intake valve 54 is closed, resulting in an increase of the amount of the intake air charged in the cylinder. When the valve timing of the intake valve 54 is advanced, a valve overlap (i.e., a period in which both the intake valve 54 and the exhaust valve 53 are open) is also extended, and the amount of intake air that flows through the cylinder is increased particularly during a transient turbo-charging period. As a result, the exhaust energy is increased, and a turbo-charging effect of the turbocharger 30 is accordingly improved. During a transient turbo-charging period, the intake air flows through the cylinder (or the combustion chamber 60) in a manner that will be described later.

Figure 4:
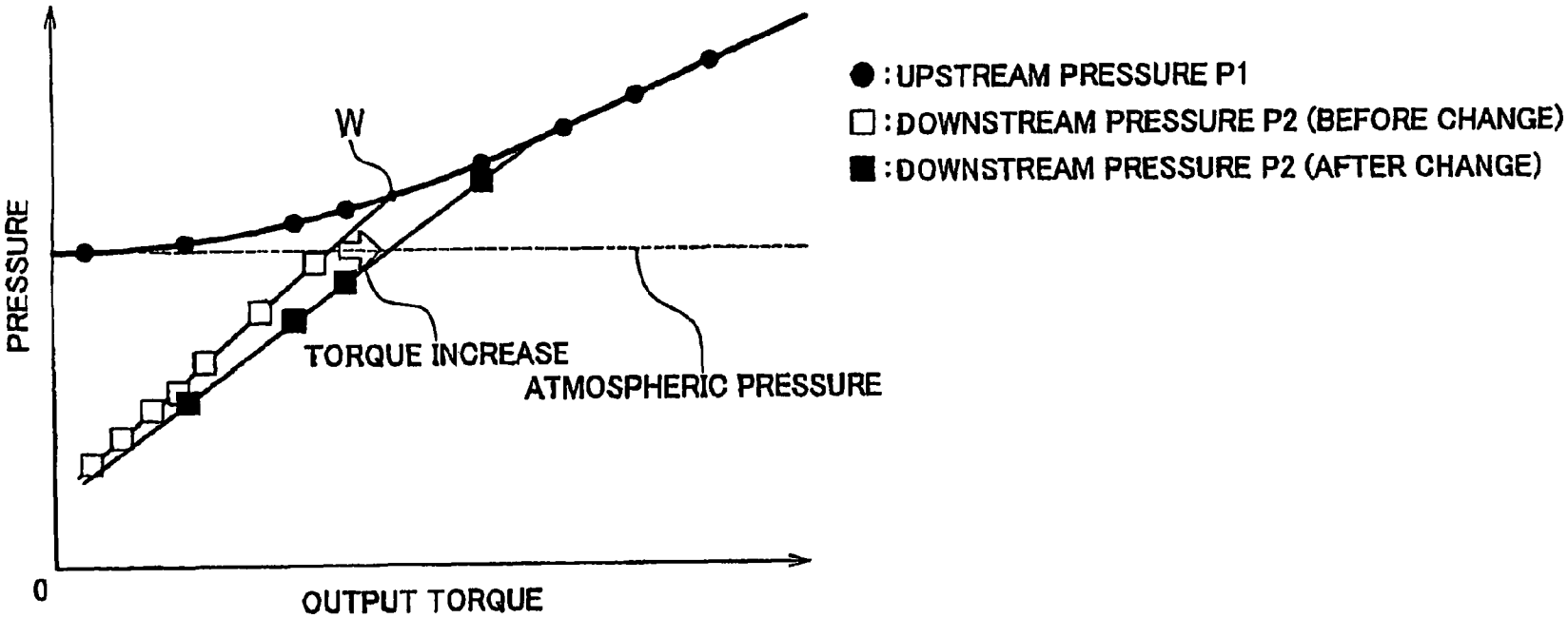
FIG. 4 is a view showing the output torque characteristics of the engine obtained when the engine speed is fixed to a given speed and the opening of a throttle valve is increased by constant degrees, with respect to the case where the valve timing of the intake valve is changed to be advanced and the case where the valve timing is not changed.

If the valve timing of the intake valve 54 is advanced, the volume in the cylinder is increased at the time when the intake valve 54 is closed, but the downstream pressure P2 is reduced, resulting in an increase of a pumping loss. In view of this, the valve timing of the intake valve 54 is advanced in step 12 in the following manner, so that the intake charging efficiency and the output torque can be maximized. FIG. 4 shows output torque characteristics of the engine 50 when the engine speed Ne is fixed to a given speed (1600 rpm in this example) and the opening of the throttle valve 14*a* is increased by constant degrees, for the case where the valve timing of the intake valve 54 is changed to be advanced and the case where the valve timing is not changed. In FIG. 4, the output torque characteristics are represented by the relationships between the output torque, and the upstream pressure P1 and downstream pressure P2.

By empirically obtaining the output torque characteristics at a given engine speed Ne as shown in FIG. 4, it is possible to specifically determine the magnitude of the output torque that increases after changing of the valve timing, while taking account of the turbo-charging effect and the pumping loss. While the valve timing that provides the maximum intake charging efficiency and output torque at a given speed Ne is determined in view of the turbo-charging effect and pumping loss, the influences of the turbo-charging effect and pumping loss are reflected by the downstream pressure P2. Accordingly, the optimum valve timing that provides the maximum intake charging efficiency and output torque changes depending upon the downstream pressure P2 at a given speed Ne. In the present embodiment, therefore, in order to change the valve timing to the optimum valve timing in accordance with the downstream pressure P2 and the engine speed Ne, map data of the optimum valve timing defined by the downstream pressure P2 and the engine speed Ne are created and stored in the ROM, and the valve timing is changed based on the map data so as to improve the output performance of the engine 50. More specifically, as a preparation to a process for controlling the hydraulic system so as to advance the valve timing of the intake valve 54, the CPU performs processes in step 12 for detecting the downstream pressure P2 and the engine speed Ne based on the output signals of the pressure sensor 17*b* and the crank angle sensor 63, and reading the optimum valve timing from the above-mentioned map data.

In the case where the valve timing is not changed, point W in FIG. 4 becomes a WOT (Wide Open Throttle) point (P1−P2≈0), and it is the most desirable in terms of the fuel economy to determine that a request for acceleration is made at point W or a point in the vicinity of point W. Meanwhile, changing of the valve timing is effected at point W or a point ahead of point W, based on the request for acceleration. As shown in FIG. 4, the valve timing is changed to the optimum valve timing so that the output torque at an equal downstream pressure P2 is increased as compared with the case where the valve timing is not changed. Also, if the valve timing of the exhaust valve 55 is retarded at the same time, as will be described later, the above-mentioned map data may be created based on the downstream pressure P2 that involves an influence of the valve timing change of the exhaust valve 55. In this embodiment, fuel injection control during a transient turbo-charging period is also performed based on map data of the fuel injection quantity defined by the downstream pressure P2 and the engine speed Ne.

In step 12, the CPU performs a process for controlling the ExVVT 62, more specifically, the hydraulic system mounted on the exhaust-side camshaft, so as to retard the valve timing of the exhaust valve 55. Since the valve overlap is extended as a result of this process, the amount of the intake air that flows through the cylinder from the intake port 52*a* into the exhaust port 52*b* can be further increased, whereby the turbo-charging effect of the turbocharger 30 can be further enhanced. Furthermore, in step 12, the CPU performs a process for controlling the turbocharger 30, more specifically, the assist motor 33, so as to assist in driving of the compressor rotor 31. With regard to the engine having the output torque characteristics as shown in FIG. 4, for example, if the accelerator pedal is depressed from a certain condition to full throttle in a stroke, the pressure difference is reduced (P1−P2≈0), and it is determined that a request for acceleration is made, so that the valve timings of the intake valve 54 and exhaust valve 55 are changed. If the accelerator pedal is depressed in a stroke, however, a turbo lag appears from the time of depression of the accelerator pedal to the time when the engine shows the output torque characteristics after changing of the valve timing as shown in FIG. 4. To deal with the turbo lag, the CPU controls the assist motor 33 in step 12 so that the output torque characteristics of the engine 50 quickly match the output torque characteristics after changing of the valve timing, thereby to provide improved output performance responsive to a rapid change in the accelerator pedal position.

Returning to FIG. 2, the CPU performs processes, subsequent to step 12, for detecting the air fuel ratio based on the output signal of the oxygen sensor 24, and determining whether the air fuel ratio is leaner than the stoichiometric ratio (step 13). If an affirmative decision (YES) is made in step 13, the CPU initially controls the ExVVT 62 so as to return the valve timing of the exhaust valve 55 to that before changing, prior to returning the valve timing of the intake valve 54, and then controls the InVVT 61 so as to return the valve timing of the intake valve 54 to that before changing (step 14). However, the valve timing of the intake valve 54 may start being returned while the valve timing of the exhaust valve 55 is being returned. In step 14, the CPU controls each of the InVVT 61 and ExVVT 62 for gradual changes, so as to return the valve timing by a certain degree each time an affirmative decision (YES) is made in step 13. In this manner, it is possible to favorably suppress reduction of the purifying or converting capability of the three-way catalyst 22 while at the same time maintaining a sufficient level of the output performance of the engine 50.

In step 12, at least one of the InVVT 61 and ExVVT 62 may be controlled for gradual changes, so that the intake valve 54 and/or the exhaust valve 55 is/are advanced or retarded by a certain degree or degrees each time an affirmative decision (YES) is made in step 11. In this case, if the ExVVT 62 is controlled for gradual changes, for example, the CPU initially controls the ExVVT 62 in step 14 so as to stop changing of the valve timing of the exhaust valve 55, and then controls the ExVVT 62 so as to return the valve timing of the exhaust valve 55 by a certain degree in step 14 each time an affirmative decision (YES) is made in step 13. In the case where the control for gradual changes is performed in step 14, step 12 will be executed in each of the subsequent cycles of the routine. In the case where the control for gradual changes is not performed, on the other hand, step 12 will be skipped in the subsequent cycles of the routine.

Figure 5:
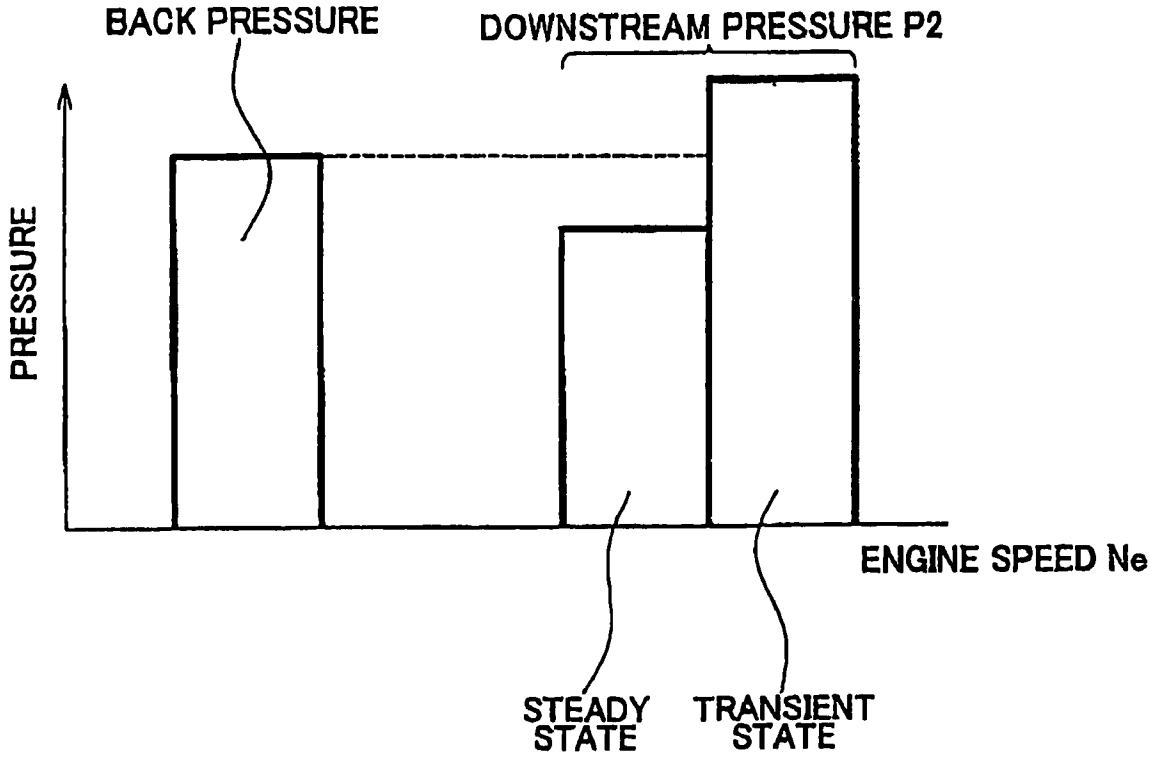
FIG. 5 is a view showing the relationships between the back pressure and the downstream pressure at a given engine speed and a given load factor (intake air amount, with respect to the case where a turbocharger is in a steady operating state and the case where the turbocharger is in a transient operating state.

If a negative decision (NO) is made in step 13, on the other hand, the CPU performs a process for correcting the ignition timing to the optimum ignition timing (step 15). FIG. 5 shows the relationship between the back pressure and the downstream pressure P2 at a given engine speed and a given load factor (intake air amount), with respect to the case where the turbocharger 30 is in a steady operating state and the case where the turbocharger 30 is in a transient operating state. During the steady turbo-charging period and the transient turbo-charging period, the valve overlap is equally extended due to changing of the valve timing. As shown in FIG. 5, the back pressure is at the same level during the steady turbo-charging period and during the transient turbo-charging period since the intake air amount is fixed to the same value as a condition for comparison. On the other hand, the downstream pressure P2 is higher than the back pressure during the transient turbo-charging period, and is lower than the back pressure in the steady turbo-charging period. Namely, even if the valve timing is changed while turbo charging is being performed, the intake air is less likely to flow through the cylinder during the steady turbo-charging period, and some amount of gas remains in the cylinder. Therefore, during the steady turbo-charging period, the degree of advance of the ignition timing needs to be controlled (e.g., reduced) in view of the residual gas so as to prevent knocking.

During the transient turbo-charging period, on the other hand, the intake air smoothly flows through the cylinder, so that the gas remaining in the cylinder is sufficiently scavenged. As a result, the possibility of occurrence of knocking is significantly reduced, which makes it possible to advance the ignition timing by a larger degree than that during the steady turbo-charging period. In this embodiment, the ignition timing is corrected to be advanced during the transient turbo-charging period in which the intake air smoothly flows through the cylinder in the above manner, so as to more favorably improve the output performance of the engine 50. If the valve timings of the intake and exhaust valves 54, 55 are returned in step 14, the CPU performs a process for returning the ignition timing in step 15, so as to correct the ignition timing to the optimum ignition timing according to the changes in the valve timings. Thus, even in the case where the valve timings of the intake and exhaust valves 54, 55 are returned by a certain degree each time step S14 is executed, the ignition timing is controlled so as to achieve desirable combustion suitable for the amount of the intake air that flows through the cylinder. Following step 15, the CPU performs a process for setting a flag indicating that the vehicle is being accelerated (which flag will be called "acceleration flag") ON (step 16).

If a negative decision (NO) is made in step 11, on the other hand, the CPU determines whether the vehicle was being accelerated in the last cycle of the routine, by determining whether the acceleration flag is ON (step 21). In step 21, the CPU also determines whether a request for a settling process is made, by determining whether a settling-process flag set in step 24 or step 25 (which will be described later) is ON. If it is determined that the vehicle was not being accelerated in the last cycle, and no request for a settling process is made, the CPU repeatedly executes step 11 and step 21 until an affirmative decision (YES) is made in step 11. If it is determined that the vehicle was being accelerated in the last cycle, or a request for a settling process is made, the CPU performs a process of step 22.

In step 22, the CPU initially controls the InVVT 61 so as to return the valve timing of the intake valve 54 to that before changing prior to returning the valve timing of the exhaust valve 55, and then controls the ExVVT 62 so as to return the valve timing of the exhaust valve 55 to that before changing. The valve timing of the exhaust valve 55 may start being returned while the valve timing of the intake valve 54 is being returned. In step 22, the CPU controls both the InVVT 61 and the ExVVT 62 for gradual changes, so as to return the valve timings by a certain degree each time an affirmative decision (YES) is made in step 21. It is thus possible to favorably improve the fuel economy by reducing the pumping loss early, and also suppress deterioration of the driveability by reducing the rate of change of the output performance.

Following step 22, the CPU determines whether the valve timings of the intake valve 54 and exhaust valve 55 become equal to respective steady-state target valve timings (step 23). If a negative decision (NO) is made in step 23, the CPU set a flag indicative of the presence of a request for a settling process (which flag will be referred to as "settling-process request flag") ON (step 24). Subsequently, the CPU sets the acceleration flag OFF (step 26), and, subsequent to step 11, performs the processes of step 21 through step 23. If an affirmative decision (YES) is made in step 23, the CPU sets the settling-process request flag OFF, and then performs the process of step 26.

Figure 6:
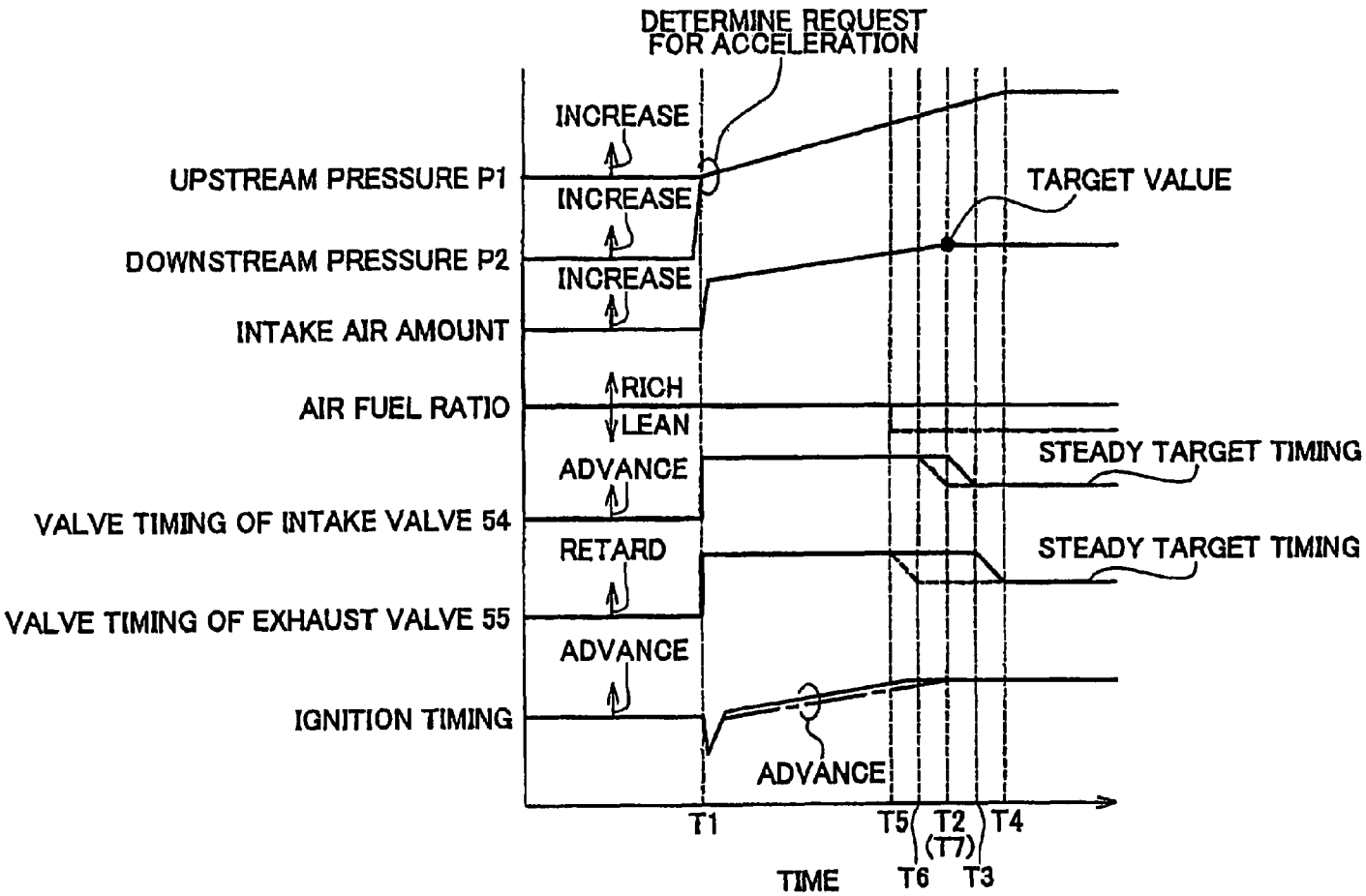
FIG. 6 is a time chart showing an example of changes in various quantities of state associated with the flowchart as shown in FIG. 2.
Figure 7A:
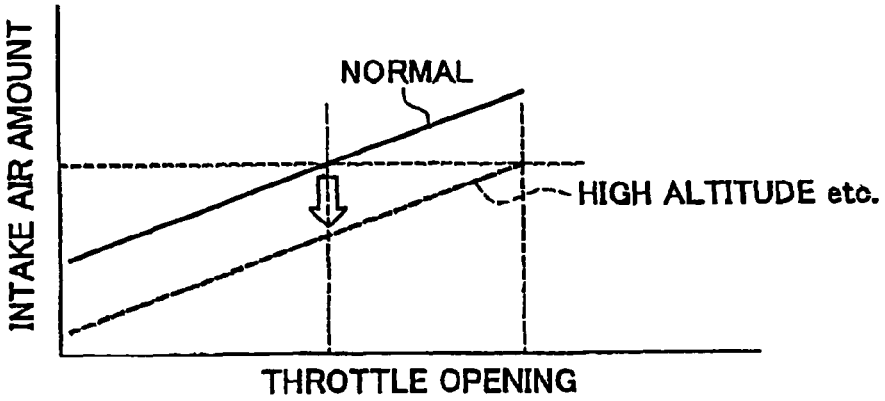
FIG. 7A and FIG. 7B are views useful for explaining problems encountered in an internal combustion engine when the presence of a request for acceleration is determined based on the throttle opening or the accelerator pedal position.
Figure 7B:
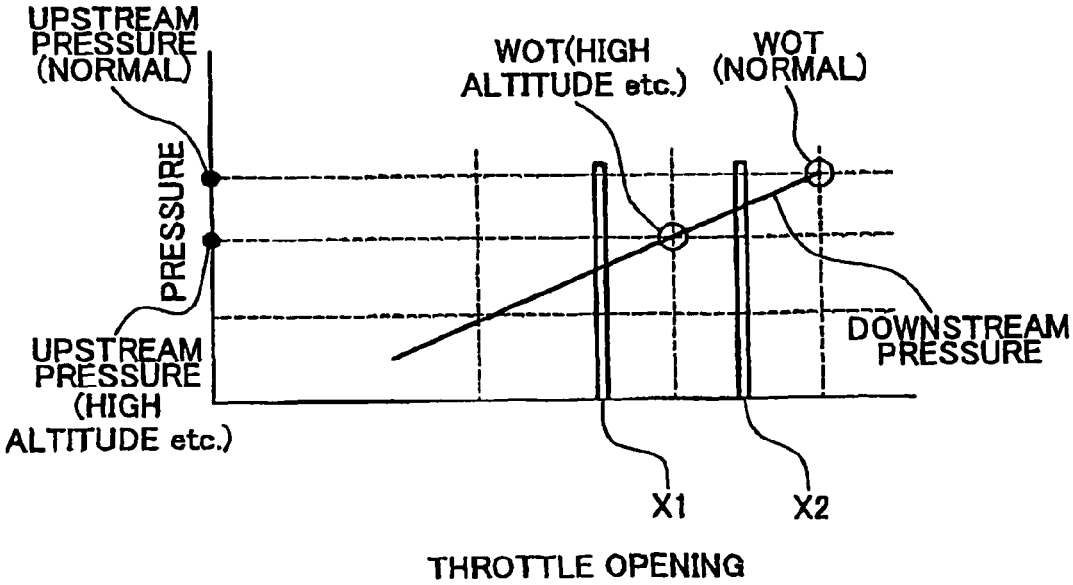

Next, an example of changes in various quantities of state, which occur as the CPU executes the control routine of the flowchart shown in FIG. 2, will be described in detail with reference to the time chart shown in FIG. 6. In FIG. 6, respective changes in the upstream pressure P1, downstream pressure P2, intake air amount, air fuel ratio determined based on the output signal of the oxygen sensor 24, valve timing of the intake valve 54, valve timing of the exhaust valve 55 and the ignition timing are schematically illustrated as changes in the various quantities of state. If the accelerator pedal is depressed, a pressure difference between the upstream pressure P1 and the downstream pressure P2 becomes equal to or lower than the above-mentioned predetermined value at time T1. At this time, it is determined in step 11 that a request for acceleration is made. Subsequently, the InVVT 62 and ExVVT 62 are controlled in step 12, so that the valve timings of the intake valve 54 and exhaust valve 55 are changed. Furthermore, the intake air amount increases as the valve timings change and the opening of the throttle valve 14*a* changes. In order to deal with a sudden increase of the intake air amount; the ignition timing is controlled to be temporarily retarded at time T1.

From time T1 to time T2 at which the intake air amount becomes equal to its target value, it is repeatedly determined in step 11 that a request for acceleration is made, and the vehicle is kept in an accelerated condition. During this period (T1-T2), the upstream pressure P1, downstream pressure P2 and the intake air amount increase as the boost pressure increases. Since the amount of intake air that flows through the cylinder increases up to time T2, the ignition timing is advanced in step 15. At time T2, the intake air amount becomes equal to the target value, and it is thus determined in step 11 that no request for acceleration is made. Then, the InVVT 61 is controlled in advance of the ExVVT 62 through repeated execution of step 22, so that the valve timing of the intake valve 54 gradually changes and reaches the steady-state target valve timing at time T3. Following the control of the InVVT 61, the ExVVT 62 is controlled through repeated execution of step 22, so that the valve timing of the exhaust valve 55 gradually changes and reaches the steady-state target valve timing at time T4. If greater importance is to be placed on the fuel economy, the InVVT 61 may not be controlled for gradual changes, but may be controlled so as to instantly change the valve timing of the intake valve 54 to the steady-state target valve timing at time T2.

If the air fuel ratio becomes lean as indicated by a broken line in FIG. 6 at time T5 between time T1 and time T2, an affirmative decision (YES) is made in step 13, and the ExVVT 62 is controlled in advance of the InVVT 61 through repeated execution of step 14, so that the valve timing of the exhaust valve 55 gradually changes and reaches the steady-state target valve timing at time T6, as indicated by a broken line in FIG. 6. Subsequently, the InVVT 61 is controlled through repeated execution of step 14, so that the valve timing of the intake valve 54 gradually changes and reaches the steady-state target valve timing at time T7, as indicated by a broken line in FIG. 6.

The request for acceleration determined by the acceleration request determining system provided by the ECU 1 in this embodiment may be used for controlling appropriate objects to be controlled, other than the turbocharger 30, the InVVT 61 and the ExVVT 62 as indicated in this embodiment. In this case, for example, the acceleration request determining means may determine the presence of a request for acceleration, based on different conditions concerning the upstream pressure P1 and downstream pressure P2, for each of the objects to be controlled based on the request for acceleration, in view of the response and function of the object to be controlled. Also, with regard to the same object to be controlled, for example, the acceleration request determining means may determine the presence of a request for acceleration in a step-by-step manner, based on different conditions concerning the upstream pressure P1 and the downstream pressure P2, in view of the response and function of the object to be controlled. Namely, the presence of a request for acceleration may be determined based on criteria that differ in degrees. Also, when it is determined whether a request for acceleration is made as in step 11 of the flowchart of FIG. 2, for example, it may be determined whether other conditions, such as those of the engine speed Ne and the water temperature, as well as the pressure difference, are also satisfied, namely; conditions for inhibiting acceleration may also be judged, and then it may be finally determined that a request for acceleration is made. The ECU 1 of the embodiment as described above favorably controls the turbocharger 30, InVVT 61 and the ExVVT 62 from a transient turbo-charging period to a steady turbo-charging period, on the basis of a request for acceleration determined based on the pressure difference, so as to improve the output performance of the engine 50 and the fuel economy when appropriate, while assuring sufficient levels of both of the output performance and the fuel economy.

The embodiment as described above is a preferred embodiment of the invention. It is, however, to be understood that the invention is not limited to the illustrated embodiment, but may be embodied with various changes or modifications, without departing from the principle of the invention.

The invention claimed is:

1. A control apparatus, comprising:

an acceleration request determining unit that determines whether a request for acceleration is made using, as determination factors, an upstream pressure and a downstream pressure of a throttle valve disposed in an intake system of a supercharged internal combustion engine in which intake air is supercharged;

a variable valve actuating mechanism control unit that controls a variable valve actuating mechanism that changes valve characteristics of at least one of an intake valve and an exhaust valve of the supercharged internal combustion engine; and an air fuel ratio determining unit that determines an air fuel ratio of exhaust gas downstream of a catalyst disposed in an exhaust system of the supercharged internal combustion engine, wherein when the acceleration request determining unit determines that the request for acceleration is made, the variable valve actuating mechanism control unit controls the variable valve actuating mechanism to change the valve characteristics of at least one of the intake valve and the exhaust valve to the valve characteristics with which output performance of the supercharged internal combustion engine is improved, and when the air fuel ratio determining unit determines that the air fuel ratio is lean, the variable valve actuating mechanism control unit controls the variable valve actuating mechanism to stop changing the valve characteristics.

2. A control apparatus, comprising:

an acceleration request determining unit that determines whether a request for acceleration is made using, as determination factors, an upstream pressure and a downstream pressure of a throttle valve disposed in an intake system of a supercharged internal combustion engine in which intake air is supercharged;

a variable valve actuating mechanism control unit that controls a variable valve actuating mechanism that changes valve characteristics of at least one of an intake valve and an exhaust valve of the supercharged internal combustion engine; and an air fuel ratio determining unit that determines an air fuel ratio of exhaust gas downstream of a catalyst disposed in an exhaust system of the supercharged internal combustion engine, wherein when the acceleration request determining unit determines that the request for acceleration is made, the variable valve actuating mechanism control unit controls the variable valve actuating mechanism to change the valve characteristics of at least one of the intake valve and the exhaust valve to the valve characteristics with which output performance of the supercharged internal combustion engine is improved, and when the air fuel ratio determining unit determines that the air fuel ratio is lean, and the valve characteristics of the intake valve and the exhaust valve are changed, the variable valve actuating mechanism control unit controls the variable valve actuating mechanism to return the valve characteristics of the exhaust valve to those before changing, in advance of the valve characteristics of the intake valve.

3. A control apparatus, comprising:

an acceleration request determining unit that determines whether a request for acceleration is made using, as determination factors, an upstream pressure and a downstream pressure of a throttle valve disposed in an intake system of a supercharged internal combustion engine in which intake air is supercharged;

a variable valve actuating mechanism control unit that controls a variable valve actuating mechanism that changes valve characteristics of at least one of an intake valve and an exhaust valve of the supercharged internal combustion engine, wherein when the acceleration request determining unit determines that the request for acceleration is made, the variable valve actuating mechanism control unit controls the variable valve actuating mechanism to change the valve characteristics of at least one of the intake valve and the exhaust valve to the valve characteristics with which output performance of the supercharged internal combustion engine is improved, and when the acceleration request determining unit determines that no request for acceleration is made, and the valve characteristics of the intake valve and the exhaust valve are changed, the variable valve actuating mechanism control unit controls the variable valve actuating mechanism to return the valve characteristics of the intake valve to those before changing, in advance of the valve characteristics of the exhaust valve.

4. The control apparatus according to claim 1, further comprising:

a pressure difference detecting unit that detects a pressure difference between the upstream pressure and downstream pressure of the throttle valve, wherein the acceleration request determining unit determines whether the pressure difference detected by the pressure difference detecting unit is equal to or smaller than a predetermined value, and determines that the request for acceleration is made when the pressure difference is equal to or smaller than the predetermined value.

5. The control apparatus according to claim 2, further comprising:

a pressure difference detecting unit that detects a pressure difference between the upstream pressure and downstream pressure of the throttle valve, wherein the acceleration request determining unit determines whether the pressure difference detected by the pressure difference detecting unit is equal to or smaller than a predetermined value, and determines that the request for acceleration is made when the pressure difference is equal to or smaller than the predetermined value.

6. The control apparatus according to claim 3, further comprising:

a pressure difference detecting unit that detects a pressure difference between the upstream pressure and downstream pressure of the throttle valve, wherein the acceleration request determining unit determines whether the pressure difference detected by the pressure difference detecting unit is equal to or smaller than a predetermined value, and determines that the request for acceleration is made when the pressure difference is equal to or smaller than the predetermined value.

7. The control apparatus according to claim 1, wherein the supercharged internal combustion engine comprises a turbocharger that includes an assist motor that assists to boost the pressure of the intake valve, and the control apparatus further comprises:

a supercharger control unit that controls the assist motor that assists in driving of the turbocharger when the acceleration request determining unit determines that the request for acceleration is made.

8. The control apparatus according to claim 2, wherein the supercharged internal combustion engine comprises a turbocharger that includes an assist motor that assists to boost the pressure of the intake valve, and the control apparatus further comprises:

a supercharger control unit that controls the assist motor that assists in driving of the turbocharger when the acceleration request determining unit determines that the request for acceleration is made.

9. The control apparatus according to claim 3, wherein the supercharged internal combustion engine comprises a turbocharger that includes an assist motor that assists to boost the pressure of the intake valve, and the control apparatus further comprises:

a supercharger control unit that controls the assist motor that assists in driving of the turbocharger when the acceleration request determining unit determines that the request for acceleration is made.

10. The control apparatus according to claim 1, further comprising:

an ignition timing control unit that controls ignition timing of the supercharged internal combustion engine, wherein the ignition timing control unit advances the ignition timing of the supercharged internal combustion engine when the acceleration request determining unit determines that the request for acceleration is made.

11. The control apparatus according to claim 2, further comprising:

an ignition timing control unit that controls ignition timing of the supercharged internal combustion engine, wherein the ignition timing control unit advances the ignition timing of the supercharged internal combustion engine when the acceleration request determining unit determines that the request for acceleration is made.

12. The control apparatus according to claim 3, further comprising:

an ignition timing control unit that controls ignition timing of the supercharged internal combustion engine, wherein the ignition timing control unit advances the ignition timing of the supercharged internal combustion engine when the acceleration request determining unit determines that the request for acceleration is made.

* * * * *